United States Patent [19]

Adams

[11] 4,448,007

[45] May 15, 1984

[54] WALL PANEL FASTENER

[76] Inventor: George C. Adams, 3055 Hunting Valley Dr., Ann Arbor, Mich. 48104

[21] Appl. No.: 256,678

[22] Filed: Apr. 22, 1981

[51] Int. Cl.[3] ..... E04B 5/52

[52] U.S. Cl. ..... 52/489; 52/100; 52/509; 52/714

[58] Field of Search ..... 52/281, 489, 714, 100, 52/509, 715

[56] References Cited

U.S. PATENT DOCUMENTS

| | | | |
|---|---|---|---|
| 2,831,222 | 4/1958 | Anderson | 52/489 |
| 3,308,590 | 3/1967 | Ettore et al. | 52/281 |
| 3,881,293 | 5/1975 | Conville | 52/489 X |
| 3,901,471 | 8/1975 | Hilgers | 52/714 X |
| 4,117,614 | 10/1967 | Weinar | 52/714 |
| 4,127,975 | 12/1978 | Judkins | 52/489 |
| 4,194,336 | 3/1980 | Weinar | 52/489 X |
| 4,333,286 | 6/1982 | Weinar | 52/714 |

*Primary Examiner*—Carl D. Friedman

*Attorney, Agent, or Firm*—Gifford, VanOphem, Sheridan, Sprinkle & Nabonzy

[57] ABSTRACT

A wallboard fastener comprising a flat base portion, an elongated tongue portion coplanar with the said base portion, a pair of flanges extending substantially normal to said base portion on opposite sides of the said tongue portion and a pair of impaling flanges mounted to said flanges so as to extend over and substantially parallel to the base portion. The improved construction of the fastener of the present invention includes an aperture in the base portion as well as in the tongue portion and separate ribs are provided for the base portion and the tongue portion so that the tongue portion is severable from the base portion without deforming the rib structures. Preferably, the fastener includes an additional rib structure disposed across the interspace between the ribs in the base portion and the ribs in the tongue portion, and which is offset from the ribs of both portions.

7 Claims, 3 Drawing Figures

WALL PANEL FASTENER

BACKGROUND OF THE INVENTION

1. Field of the Invention

The present invention relates generally to paneled wall constructions in which wall panels are secured to studs on a wall frame and, more particularly, to clips which are impaled in the edge of the wall panel and which are directly secured to the studs of the frame.

2. Description of the Prior Art

The mounting of wall panels to wall frames can be accomplished in a number of ways. Preferably, however, it is most desirable to secure the wall panels to the frame without marring the surface appearance of the wall panels and in a manner which does not require the use of a decorative cover over the joint of adjacent panels to hide the fastening devices. Accordingly, a number of panel mounting clips which secure the panels to the studs of the wall frame and which permit adjacent panels to be interlocked with respect to one another have been developed.

The first clip of this type is disclosed in U.S. Pat. No. 3,308,590 to Ettore et al. The fastener of Ettore et al comprises a flat base portion having a hole therethrough so that the base portion can be mounted to a wall structure. The shoulder extends normally from one end of the base portion. A pair of flat legs extend outwardly from the shoulder and the legs are substantially coplanar with the base portion. Sharp pins extend outwardly from the top of the shoulder in the same direction as the legs but spaced apart from and parallel to the legs. The pins are embedded in the edge of a wall panel so that the shoulder abuts against the edge of the panel. Thus, the legs extend behind the rear surface of the wall panel while the base extends outwardly from the edge of the panel and can be secured to a stud in the wall structure. The Ettore et al clip has proven to be quite satisfactory for its intended purpose.

Another previously known fastener for mounting wall boards is disclosed in U.S. Pat. Nos. 4,117,644 and 4,221,095 to Weinar. Weinar discloses a fastener comprising a plate portion and a tongue portion extending from the center of the plate portion in a coplanar arrangement. A web which extends substantially normal to the plate, supports an impaling flange adjacent each side of the tongue which extends outwardly from the top of the web in a spaced apart but parallel relationship to the plate portion. An elongated depression extends across the plate and tongue portions, and an elongated slot is disposed in the tongue portion of the depression. The Weinar clip suffers the disadvantage that the fastener can only be secured to a wall structure through the tongue portion. Thus, the fastener of Weinar is not suited for use in securing a wall board in the corner of a wall structure. Furthermore, the side walls of the depression serve to strengthen the coplanar disposition of the tongue and plate portions so that modification of their coplanar relationship is extremely difficult.

SUMMARY OF THE PRESENT INVENTION

The present invention overcomes the above mentioned disadvantages by providing a wall panel fastener which, when installed, is disposed behind the rear surface of the wall panel to be hung and which can be secured to a stud member adjacent or directly behind the wall panel to be mounted. In addition, the fastener includes segmented supporting ribs which strengthen the fastener against inadvertent deformation but which permit the tongue portion to be easily severed from the main body portion to permit the fastener to be used for mounting a wall panel in the corner of a wall structure. At the same time, these strengthening ribs serve to support the wall panels a slight distance away from the studs to which the panels are secured so that the head of the fastener used in installing the clip fits between the stud and the wall panel and the adjacent panels lie flush.

The fastener of the present invention generally comprises a sheet of material with a flat base portion having a tongue extending outwardly therefrom in a coplanar arrangement. A pair of flanges extend upwardly from the base portion and have impaling flanges extending outwardly from the top thereof in a spaced but parallel relationship to the base portion. Both the base and the tongue include apertures adapted to receive a fastener therethrough. A pair of elongated ribs are aligned on opposing sides of each aperture. The ribs in the base portion are spaced from the ribs in the tongue portion. Preferably, a short rib is disposed in the interspace between the ribs in the tongue section and the ribs in the base section, and is parallel to, but offset from the ribs of the tongue and base portions.

Thus, the present invention provides a fastener which permits a wall panel to be secured to a stud behind the rear surface of the panel as well as to a stud adjacent to the wall panel being mounted. Nevertheless, when it is desired to mount a wall panel in the corner of a wall structure, the tongue portion is removed from the base portion by severing the tongue from the base intermediate the ribs. Accordingly, the aperture in the base portion receives the fastener therethorugh and thus secures the wall panel engaged by the inpaling flanges to a stud in the corner of the wall structure.

BRIEF DESCRIPTION OF THE DRAWING

The present invention will be more clearly understood by reference to the following detailed description when read in conjunction with the accompanying drawing in which like reference characters refer to like parts throughout the several views and in which.

DETAILED DESCRIPTION OF A PREFERRED EMBODIMENT OF THE PRESENT INVENTION

Figure 1:
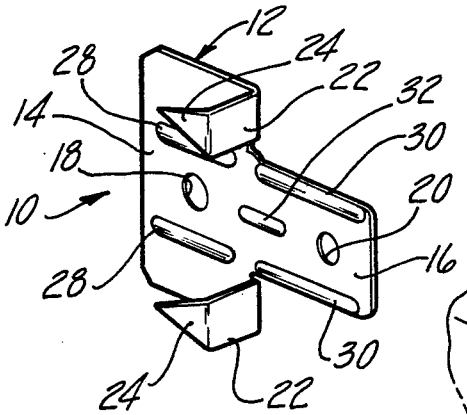
FIG. 1 is a perspective view of a fastener of the present invention.

Referring first to FIG. 1, a fastener 10 according to the present invention is thereshown comprising a sheet material 12 of such as metal. The sheet 12 includes the base portion 14 and a coplanar elongated tongue portion 16 extending outwardly from the base portion 14. Each of the portions 14 and 16 are provided with a substantially centrally located aperture 18 and 20, respectively. Raised flanges 22 extend outwardly substantially normal to the plane of the base 14 at one edge of the base adjacent each side of the tongue 16. Each flange 22 supports an impaling flange 24. Each impaling flange 24 extends outwardly above the base section 14 in a substantially parallel but spaced apart relationship.

Still referring to FIG. 1, a pair of ribs 28 are aligned along opposing sides of the aperture 18. The ribs extend upwardly out of the plane of the base section 14 toward the impaling flanges 24. Preferably, the ribs are formed by punching or depressing portions of the plate section 14.

Similarly, the tongue section 16 includes a pair of ribs 30 disposed on opposite sides of the aperture 20. As shown in FIG. 1, the ribs 30 are aligned along the peripheral sides of the tongue 16 and in the embodiment shown are aligned with the ribs 28 in base section 14. Nevertheless, the ribs 30 are spaced apart from the ribs 28 so as to provide a substantially flat portion therebetween for a reason to be discussed in detail hereinafter.

As also shown in FIG. 1, the fastener 10 preferably includes a further strengthening rib 32 extending across the junction between the base section 14 and the tongue section 16. The intermediate rib 32 is spaced apart from the ribs 28 and 30 and preferably is located substantially within the interspace between the ribs 28 and 30.

Figure 3:
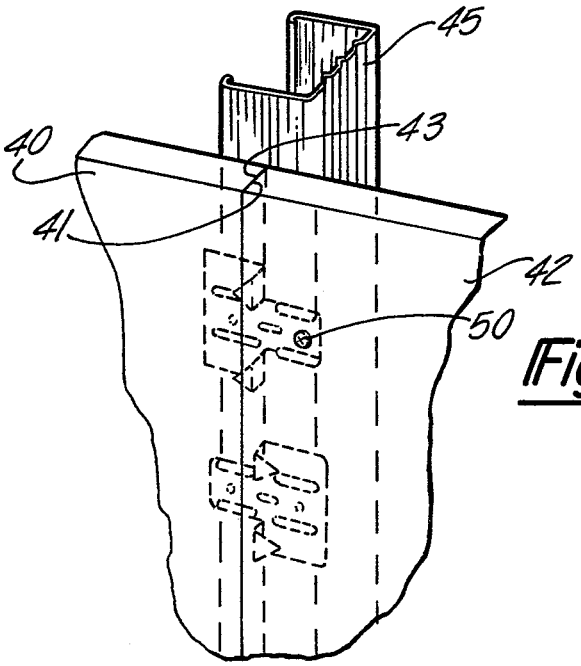
FIG. 3 is a perspective view of the fasteners of the present invention as secured to adjacent wall panels.

As best shown in FIG. 3, the fastener 10 of the present invention typically provides an interlocking connection between adjacent wall panels 40 and 42. A first fastener 10 is secured to the panel 40 by embedding flanges 24 into an edge 41 of the panel 40 so that the base portion 14 extends behind the rear surface of the panel 40. Additional fasteners 10 are mounted to the edge 41 in a similar fashion in a spaced apart arrangement (not shown) which is a well known arrangement. A fastener, such as a screw 50, is then installed through the aperture 20 in one or more of the installed fasteners 10 to secure the wall panel 40 to a stud 45 of a wall structure.

A plurality of fasteners 10 are then secured to the edge 43 of panel 42 by impaling the flanges 24 in the edge 43 of the panel. A plurality of such fasteners 10 are secured along the edge 43 in a spaced arrangement which is offset from the arrangement of fasteners positioned along the edge 41 of panel 40. The tongue section 16 of the fasteners secured to the edge 43 of panel 42 is then slid behind the panel 40 to secure the panel against the wall structure in lateral abutment with the first wall panel 40.

It can be seen that the ribs 28 and 30 press against the rear surface of the panels 40 and 42 so that the panels are spaced slightly from the stud 45. Thus, these ribs effect a counterbore for the head of the fastener 50 and thus, permit the front surfaces of the panels 40 and 42 to remain flush. The central rib 32 serves to retain the coplanar relationship of the tongue 16 with respect to the base portion 14 while the panel 42 is being slid into position with respect to the mounted panel 40. In addition, it will be understood that when the fasteners 10 are installed on a wall panel prior to shipment of the panels to a construction site, the central rib 32 serves to prevent inadvertent deformation of the tongue 16 with respect to the base 14 while the panels are being handled and transported.

Figure 2:
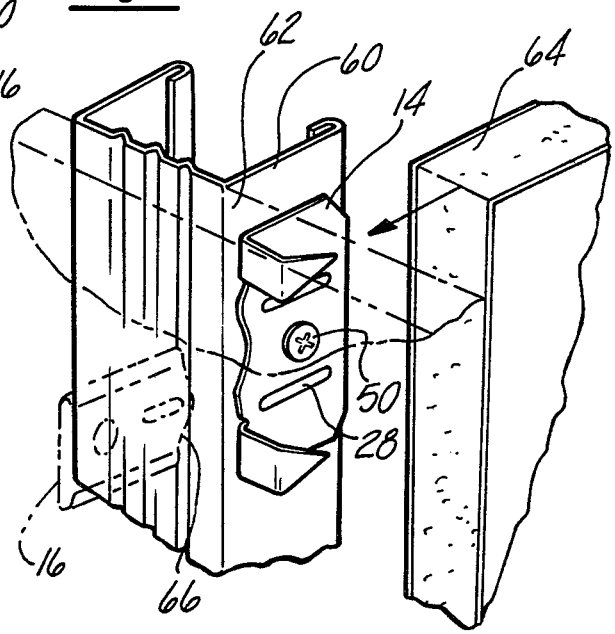
FIG. 2 is a perspective view of a fastener installed on a wall panel which is secured at the corner of a wall structure.

Referring now to FIG. 2, it can be seen that the fastener 10 of the present invention is especially useful in connecting wall panels to a corner stud in a wall construction. As best shown in FIG. 2, the fastener 10 can be secured to a stud through the aperture 18 in the base section of the fastener. When the stud is in the corner of the wall construction such as stud 60 shown in FIG. 2, tongue section 16 is removed from the fastener 10 so that the other corner stud 62 can abut against the flanges 22 of the fasteners which are entrained in the edge of the wall panel 64. Removal of the tongue 16 is facilitated by the separation between strengthening ribs 28 and 30. When the tongue section 16 is removed, the offset strengthening rib 32 is no longer necessary. Since it is offset from the ribs 28, the fastener 10 can easily be sliced or broken through the interspace between the ribs 28 and 32 substantially as shown by the mark 66 in FIG. 2. Since the ribs 28 are not deformed or affected by the cut in the interspace between the ribs 28 and 32, they still serve to provide the proper space between the stud 60 and the panel 64 and provide a clearance space for the head of the fastener 50.

It should also be understood that the strengthening rib 32 can be made to terminate at a point substantially aligned with the flanges 22 of bracket 10 so that the tongue portion 16 can be bent normal the base portion 14 without requiring actual cutting of the fastener 10. In any event, it will be understood that the fastener 10 of the present invention provides a handy means for mounting wall panels to a wall frame in a manner which does not deface the exposed surfaces of the wall panels. At the same time, they provide means for securely interlocking adjacent wall panels secured to a wall structure. In addition, the ribs provide strength to the structure as well as a means for providing a clearance space for the head of a fastener between the stud and the wall panel. The spacing between the ribs enables the tongue to be removed without deforming the rib structures. Moreover, unlike previously known wall board fasteners, the fasteners can be secured to a stud through its base portion which extends behind the panel to be mounted. A combination of these features provides a clip which is especially advantageous for use in securing wall panels to a stud in a corner of a wall construction.

Having thus described the fastener of the present invention, many modifications thereto will become apparent to those skilled in the art to which it pertains without departing from the scope and spirit of the invention as defined in the appended claims.

What is claimed is:

1. A wallboard fastener comprising a single piece of sheet material having:

a base portion, said base having a first aperture therethrough;

a tongue portion extending outwardly from and coplanar with said base portion, said tongue portion having a second aperture therethrough and said tongue having two sides which intersect said base portion;

a pair of first flanges, each flange extending substantially perpendicularly outwardly from said base portion, one first flange disposed on each side of said tongue;

a pair of impaling flanges, each impaling flange extending from one first flange in a plane parallel to but spaced from said base portion, said impaling flanges overlying a portion of said base portion, at least one rib formed in said base portion, said base rib protruding outwardly from said base portion in the same direction as said first flanges, and at least two ribs formed in said tongue portion, said tongue ribs protruding outwardly from said tongue in the same direction as said first flanges, one tongue rib being formed adjacent each side of said tongue so that said tongue aperture is positioned in between said tongue ribs, said tongue ribs terminating short of an edge of said tongue portion most spaced from said base portion.

2. The invention as defined in claim 1 and comprising at least a pair of ribs in said base portion, one rib on each of two opposite sides of said first aperture, said ribs terminating short of said first flanges.

3. The invention as defined in claim 1 wherein said fastener comprises a further rib intermediate and spaced apart from said tongue and base ribs.

4. The invention as defined in claim 1 wherein said base and tongue ribs comprise depressions formed in said base and tongue portions.

5. The invention as defined in claim 4 in combination with a wallboard panel and a wall frame having a plurality of studs including perpendicularly aligned studs at at least one corner, wherein said base portion extends along one surface of said panel, said first aperture is positioned at a point on said surface and said impaling flanges impale an edge of said panel whereby upon removal of said tongue, a fastener installed through said first aperture and embedded in said first perpendicular stud secures said panel to said wall frame while said edge is permitted to abut against said second stud, wherein said fastener is truncated intermediate said base and tongue depressions.

6. The invention as defined in claim 4 in combination with a wallboard panel and a wall frame having a plurality of studs including perpendicularly aligned studs at at least one corner, wherein said base portion extends along one surface of said panel, said first aperture is positioned at a point on said surface and said second flanges impale an edge of said panel whereby upon removal of said tongue, a fastener installed through said first aperture and embedded in said first perpendicular stud secures said panel to said wall frame while said edge is permitted to abut against said second stud, wherein said fastener is truncated intermediate said base and tongue depressions and aside from said third depression.

7. The invention as defined in claim 1 in combination with a wallboard panel and a wall frame having a plurality of studs including perpendicularly aligned studs at at least one corner, wherein said base portion extends along one surface of said panel, said first aperture is positioned at a point on said surface and said impaling flanges impale an edge of said panel whereby upon removal of said tongue, a fastener installed through said first aperture and embedded in said first perpendicular stud secures said panel to said wall frame while said edge is permitted to abut against said second stud.

* * * * *